US011577154B2

(12) United States Patent
Saarinen et al.

(10) Patent No.: US 11,577,154 B2
(45) Date of Patent: Feb. 14, 2023

(54) GAME TABLE AND GAME EQUIPMENT

(71) Applicant: 4 FEET UNDER OY, Helsinki (FI)

(72) Inventors: Jarno Saarinen, Helsinki (FI); Mika Korhonen, Helsinki (FI)

(73) Assignee: 4 FEET UNDER OY, Helsinki (FI)

( * ) Notice: Subject to any disclaimer, the term of this patent is extended or adjusted under 35 U.S.C. 154(b) by 178 days.

(21) Appl. No.: 16/960,469

(22) PCT Filed: Jan. 8, 2019

(86) PCT No.: PCT/FI2019/050009
§ 371 (c)(1),
(2) Date: Jul. 7, 2020

(87) PCT Pub. No.: WO2019/138158
PCT Pub. Date: Jul. 18, 2019

(65) Prior Publication Data

US 2020/0338441 A1 Oct. 29, 2020

(30) Foreign Application Priority Data

Jan. 9, 2018 (FI) ..... 20185025

(51) Int. Cl.
*A63F 7/36* (2006.01)
*A47B 13/08* (2006.01)
(Continued)

(52) U.S. Cl.
CPC ..... *A63F 7/36* (2013.01); *A47B 13/083* (2013.01); *A47B 13/12* (2013.01); *A47B 37/00* (2013.01);
(Continued)

(58) Field of Classification Search
CPC ..... A63F 7/36; A63B 71/02
See application file for complete search history.

(56) References Cited

U.S. PATENT DOCUMENTS 4,030,734 A 6/1977 Castellucci
6,289,910 B1 * 9/2001 Zheng ..... E04H 15/006 135/125
(Continued)

FOREIGN PATENT DOCUMENTS

CN 205006349 U 2/2016
CN 205053281 U 3/2016
(Continued)

OTHER PUBLICATIONS

International Search Report issued by the Finnish Patent and Registration Office acting as the International Searching Authority in relation to International Application No. PCT/FI2019/050009 dated Apr. 24, 2019 (4 pages).
(Continued)

*Primary Examiner* — Eugene L Kim
*Assistant Examiner* — Christopher Glenn
(74) *Attorney, Agent, or Firm* — Robert P. Michal, Esq.; Carter, DeLuca & Farrell LLP

(57) ABSTRACT

A game table and to a game equipment for playing a ball game with legs. The game table includes a table top structure with a see-through table top surface. The table top structure has a first and second table top ends and a first and second table top sides extending between the first and second table top ends. The game table further includes a first table side wall and a second table side wall extending downwards from the table top structure. The first and second table side walls being arranged to form a channel-like game space together with the table top structure, the channel-like game space having a first opening and a second opening at opposite ends of the channel-like game space.

3 Claims, 5 Drawing Sheets

(51) Int. Cl.
*A47B 13/12* (2006.01)
*A47B 37/00* (2006.01)
*A63F 7/00* (2006.01)

(52) U.S. Cl.
CPC ..... *A63F 7/0017* (2013.01); *A63B 2209/00* (2013.01)

(56) References Cited

U.S. PATENT DOCUMENTS 7,584,720 B1 * 9/2009 Jackson ..... A01K 1/033 119/482
8,132,537 B2 * 3/2012 Trunnell ..... A01K 1/034 119/496
8,974,325 B1 * 3/2015 Zucca ..... A63B 69/0097 473/434
9,420,879 B1 * 8/2016 Brandenberg ..... A47B 83/045
2003/0181264 A1 * 9/2003 Yoon ..... A63B 71/023 473/421
2003/0183264 A1 * 10/2003 Zheng ..... E04H 15/58 135/126
2010/0259075 A1 10/2010 de la Rive Box
2010/0300371 A1 * 12/2010 Oeltjen ..... A01K 1/034 119/501
2013/0102423 A1 * 4/2013 Hammons ..... A63B 71/022 473/451
2016/0192615 A1 * 7/2016 Parness ..... A01K 1/0245 119/453
2018/0245737 A1 * 8/2018 Pearson ..... F16M 3/00

FOREIGN PATENT DOCUMENTS

EP 1183964 A1 3/2002
GB 415549 A 8/1934

OTHER PUBLICATIONS

Written Opinion of the International Searching Authority issued by the Finnish Patent and Registration Office acting as the International Searching Authority in relation to International Application No. PCT/FI2019/050009 dated Apr. 24, 2019 (7 pages).
Finnish Search Report issued by the Finnish Patent and Registration Office in relation to Finnish Application No. 20185025 dated Sep. 7, 2018 (1 page).

* cited by examiner

GAME TABLE AND GAME EQUIPMENT

CROSS-REFERENCE TO RELATED APPLICATIONS

This application is a national phase entry under 35 U.S.C. 371 of PCT International Application No. PCT/FI2019/050009 filed Jan. 8, 2019, which claims priority to Finnish Patent Application No. 20185025, filed Jan. 9, 2018, the disclosure of each of these applications is expressly incorporated herein by reference in their entirety.

FIELD OF THE INVENTION

The present invention relates to a game table for exercise by playing a ball game with legs.

BACKGROUND OF THE INVENTION

There are a number of indoor game equipment for exercise by playing ball games. However, the known indoor game equipment are limited to games which may be played with hands. This is mainly due to reasons, that it has been assumed that playing a ball game indoors requires large spaces and may be dangerous. At the same time, indoor exercise equipment for exercising legs contain only exercise machines designed for planned repetitive physical work outs. Furthermore, there exists no game equipment for exercise by playing ball games for people having limited leg mobility or restricted ability to hold themselves up standing while playing a ball game with legs.

Therefore, there exists a need for new kind of exercise equipment for playing a ball game with legs, especially indoors.

BRIEF DESCRIPTION OF THE INVENTION

An object of the present invention is to provide an exercise equipment so as to solve or at least alleviate the prior art disadvantages.

The preferred embodiments of the invention are disclosed in the dependent claims.

The invention is based on the idea of providing a game table for exercise by playing a ball game with legs. It should be noted, that table conventionally comprises a table top surface supported at a predetermined height from a floor or ground with a standing support structure, such as table legs or the like.

The game table of the present invention comprises a table top structure with a see-through table top surface. The see-through table top surface means that a person may visually see through table top surface to the underside of the table top surface from above the game table. The table top structure further has a first table top end and a second table top end, as well as a first table top side and a second table top side. The first and second table top sides extend between the first and second table top ends. Thus, the see-through table top surface is provided in the area between the first and second table top ends and the first and second table top sides. The game table further comprises a first table side wall structure extending downwards from the table top structure and a second table side wall structure also extending downwards from the table top structure. The first and second table side wall structures comprise table side walls extending downwards from the table top structure towards a floor or ground. Thus, the first and second table side wall structures may also provide standing supports for the game table and the table top structure.

In the game table of the present invention, the first and second table side wall structures being arranged to form a channel-like game space together with the table top structure. The channel-like game space having a first opening and a second opening at opposite ends of the channel-like game space. Accordingly, the table top structure forms the top wall of channel-like game space and the table side wall structures form the side walls of the channel-like game space. It should be noted, that the bottom wall of the channel-like game space may be formed by floor or ground or it may be formed with a bottom wall structure of the game table. Furthermore, the first and second table wall structures or the first and second table walls, respectively, are arranged opposite to each other such that the channel-like game space may be provided between them.

The first and second table top side wall structures may be releasably connected to or secured to the table top structure such that the game table may be dismounted. The first and second table top side wall structures may be releasably connected to the table top structure with any known kind of mechanical connection and mechanical connection elements.

The see-through table top surface of the table top structure is arranged to provide a see-through structure into the channel-like game space. The see-through structure of the table top surface enables visibility from outside the channel-like game space and/or from above the channel-like game space into the channel-like game space. This enables a person or player to see the ball and also the legs of the other person or player in the channel-like game space during playing the game.

The persons playing the ball game with legs are located at the opposite openings and the opposite ends of the channel-like game space and outside the channel-like game space. The actual game is played with legs inside the channel-like game space. The table top structure and the table side wall structures prevent the ball from escaping the channel-like game space, while the players may play ball with legs through first and second openings at opposite ends of the channel-like game space. Thus, the first and second openings of the channel-like game space provide access for the legs into the channel-like game space for playing ball. Furthermore, the see-through table top surface allows the players to visually see inside the channel-like game space from above the game table. Therefore, enabling the game to be played such that the player does not have to be inside the channel-like game space or look through the first or second opening of the channel-like game space.

In a preferred embodiment of the present invention, the length of the table top structure between the first and second table top ends is greater than the width of the table top structure between the first and second table top sides. Alternatively, or additionally, it may be defined that the length of the channel-like game space between the first and second openings is greater than the width of the channel-like game space between the first and second table side wall structures or first and second table side walls. Further alternatively or additionally, the length of the channel-like game space between the first opening and second opening is equal to or greater than width of the first and second opening between the first and second side wall structures or in the direction between the first and second table top sides. The adequate length of the game space enables the game to be played such that the legs of the players at opposite ends of the channel-like game space are space apart from each other.

In one embodiment, the mentioned length is at least equal to or greater than the mentioned width. Alternatively, the mentioned length is at least equal to or greater than 1.25 times the mentioned width or 1.5 times greater than the mentioned width, or preferably between 1.25-3 times greater than the width, or between 1.4-2.5 times greater than the width, or for example approximately 2 times greater than the width. This allows an adequate game space for legs, such that the legs of the players at opposite ends of the game table do not collide to each other.

The height of the game table may be at least 55 cm, or at least 65 cm or equal to or greater than 75 cm. This means that the table top structure or the table top surface may be at the mentioned height from floor or ground or from a bottom structure or bottom wall of the game table. Alternatively, the height of the first and second openings of the channel-like game space may be at least 55 cm, or at least 65 cm or equal to or greater than 75 cm from the floor, ground or bottom of the game table. The mentioned height enables players to play the game with legs through first and second openings of the channel-like game space.

The width of the game table may be at least 60 cm, or at least 70 cm or equal to or greater than 90 cm or even equal to or greater than 95 cm. This means that the first and second table side wall structures or the first and second table side walls may be at the mentioned width or distance from each other. Alternatively, the width of the first and second openings of the channel-like game space may be at least 60 cm, or at least 70 cm or equal to or greater than 90 cm from the floor, ground or bottom of the game table. The mentioned width provides adequate space for legs in width direction of the channel-like game space.

The length of the game table may be at least 100 cm, or at least 120 cm or equal to or greater than 140 cm or even equal to or greater than 160 cm. This means that the table top structure or the table top surface may have the mentioned length or the first and second table top ends are at the mentioned distance from each other. Alternatively, the distance between the first and second openings of the channel-like game space may be at least 100 cm, or at least 120 cm or equal to or greater than 140 cm. The mentioned length enables players to play the game with legs through first and second openings of the channel-like game space such that collisions of the players legs may be minimized or prevented.

In one embodiment of the present invention, the table top structure comprises one or more table top openings arranged to form the see-through table top surface into the game space from above the table top structure. Thus, the table top structure comprises one or more viewing openings via which the player may see inside the channel-like game space. Accordingly, the table top structure comprises one or more table top openings arranged to form the see-through table top surface, and the see-through table top surface is arranged to provide a see-through structure into the game space.

In another embodiment, the table top structure may comprise a solid table top wall made of transparent material and arranged to form top wall surface of the game space and the see-through table top surface into the game space from above the table top structure. In this embodiment, the table top surface is formed with a transparent plate material, which may be rigid or flexible or elastic. The transparent solid table top wall may be made for example from glass, acryl, plastic, textile, woven, non-woven or some synthetic material. Thus, the table top wall may be made of plate-material or it may be plate-like. The transparency in this context means, the solid table top wall is transparent in a degree allowing the player to see inside the channel-like game space while playing. Accordingly, the table top structure comprises a solid or plate-like table top wall made of transparent material and arranged to form the see-through table top surface, and the see-through table top surface is arranged to provide a see-through structure into the game space.

In an alternative embodiment, the table top structure may comprise a net-like or mesh-like table top wall having plurality of net apertures and arranged to form top wall surface of the game space and the see-through table top surface into the game space from above the table top structure. In this embodiment, the player may see into the channel-like game space via the net apertures. The net-like or mesh-like table top surface may be formed rigid or flexible or elastic. The net-like or mesh-like table top wall may be made for example from plastic, metal, wood, cardboard, textile material, woven, non-woven or some synthetic material. Accordingly, the table top structure comprises a net-like table top wall having plurality of apertures and arranged to form the see-through table top surface, and the see-through table top surface is arranged to provide a see-through structure into the game space.

In one embodiment, the table top structure comprises a first table top side support forming the first table top side and extending between the first table top end and the second table top end, and a second table top side support forming the second table top side and extending between the first table top end and the second table top end. The table top wall may be supported to the first and second table top side supports. Accordingly, the first and second table top side supports may form the side edges of the table top structure or the table top surface. The table top side supports may support the table top wall, and thus the table top structure may be provided as dismountable structure.

In an alternative embodiment, the table top structure may comprise a first table top side support forming the first table top side and extending between the first table top end and the second table top end, and a second table top side support forming the second table top side and extending between the first table top end and the second table top end. The table top structure may further comprise a first table top end support forming the first table top end and extending between the first table top side and the second table top side, and a second table top end support forming the second table top end and extending between the first table top side and the second table top side, the table top wall being supported to the first and second table top end supports and to the first and second table top side supports. In this embodiment, the table top wall may be supported from all directions and the structure of the table top structure and the game table may be provided sturdy and dismountable. Accordingly, the table top structure may comprise a table top frame formed by the first and second table top sides supports and first and second table top ends supports.

The first table side wall structure and the second table side wall structure may comprise a solid side wall made of transparent or non-transparent material and arranged to form side wall surface of the channel-like game space. The table side wall may be made for example from glass, acryl, metal, wood, cardboard, plastic, textile material or some synthetic material. The table side wall may be non-transparent, but in preferred embodiment it may be transparent for enabling spectator to watch the game though the table side wall structure. The transparency in this context means, the solid table side wall is transparent in a degree allowing the spectators to see inside the channel-like game space through the table side walls.

In an alternative embodiment, the first table side wall structure and the second table side wall structure may comprise a net-like or mesh-like side wall having plurality of net apertures and arranged to form side wall surface of the channel-like game space and a see-through table side wall into the channel-like game space. In this embodiment, the spectators may see into the channel-like game space via the net apertures of the table side walls. The net-like or mesh-like table side wall may be made for example from plastic, metal, wood, cardboard, textile material or some synthetic material.

The table side walls may be provided detachable or removable such that the they may be dismounted from the game table. The detachable structure may be provided with any known manner using mechanical fasteners, quick connections, screws, fins, Velcro-connection or the like.

The table side walls additionally or alternatively be arranged to be raised or uplifted or lowered down or drawn to side for opening the side wall of the channel-like game space partially or fully. For example, when the table side walls are made from flexible or elastic material, they may be lifted from the bottom end and rolled up or gathered together and attached in the together collected form to upper part of the table side wall structure or the table top structure, for example the table top side supports for keeping the side wall open. Alternative, the table side walls may be lowered from the upper end and rolled up or gathered together and attached in the together collected form to lower part of the table side wall structure or the bottom structure or table bottom wall, for example the side edges of the table bottom wall for keeping the side wall open. Yet alternatively, the table side walls may be drawn sideways and rolled up or gathered together and attached in the together collected form to first or second end of the side wall structure or to or in vicinity of the first or second opening of the channel-like game space.

The table side wall which is arranged to be detached or raised or uplifted, enables placing two or more game tables adjacently to each other, preferably in contact with each other for forming an enlarged game space. Accordingly, the table side walls between adjacent game tables are detached or removed or alternatively they may be raised or uplifted such that the game spaces of the adjacent game tables are joined together allowing more than two people to play the game together.

The first table side wall and the second table side wall may be made of rigid material, flexible material or elastic material. Flexible and elastic material may be advantageous as they prevent the players from hurting their legs during playing.

The first and second table side wall structure may further comprise table support legs extending from the table top structure downwards. The table support legs may be any kind of support legs suitable for supporting the table top structure and the table side walls. However, it should be noted that the table support legs may also be omitted, and the first and second table side walls may provide necessary support for the table top structure.

In one embodiment, the game table may further comprise a detachable table end wall which may be arranged to the first or second openings of the channel-like game space for closing the first or second opening. The detachable table end wall may also be arranged between the first and second openings of the channel-like game space closing the channel-like game space. The table end wall extends upwards from the floor, ground or bottom structure of the game table and parallel to the first and second openings. It may extend between the floor, ground or bottom structure of the game table and the table top structure, or only to a distance from the table top structure. The table end wall is preferably rigid or elastic such that a ball may bounce from it, but it may also be flexible when desired. The detachable end wall enables a single person to play the game by kicking the ball inside the channel-like game space against the table end wall.

In one embodiment, the first and second table side wall structure comprise support legs extending from the table top structure downwards. The first and second table side wall structure may comprise one table support leg provided in connection with each of the first and second table top end such that the table support legs define the first and second openings with the first and second table top ends, respectively, at the opposite ends of the channel-like game space. Accordingly, the table support legs define the vertical or upwards extending edges of the first and second openings at the opposite ends of the channel-like game space. Accordingly, the mentioned table support legs may be provided to the corners of the table top structure at the first and second ends of the channel-like game space.

In one embodiment, the first and second table side walls are connected to the table support legs, respectively, and the first and second table side wall form side wall surfaces of the channel-like game space. Therefore, the table support legs provide support or connection points for the table side walls. This may allow the table side wall structure to be provided as dismountable structure. Furthermore, the table side walls may be drawn sideways and rolled up or gathered together and attached in the together collected form to the first or second table support leg of the first and second side wall structure.

In an alternative embodiment, the first and second table side walls are connected to the table support legs and to the first and second table top side supports, respectively, and the first and second table side walls form side wall surfaces of the channel-like game space. Therefore, the table support legs and the table top side supports together provide support or connection points for the table side walls. This may allow the table side wall structure to be provided as dismountable structure and also a sturdy structure enabling proper playing.

In one embodiment, the game table comprises a first table end frame provided in connection with the table top structure. The first table end frame has a generally U-shaped or C-shaped form defining the first opening of the channel-like game space and arranged to form the table support legs and the first table top end. The game table further comprises a second table end frame provided in connection with the table top structure. The second table end frame has a generally U-shaped or C-shaped form defining the second opening of the game space and arranged to form the table support legs and the second table top end. Accordingly, the frame forms part of the table side wall structure and part of the table top structure. In this embodiment, the U-shaped or C-shaped frame opens downwards such that the web of the frame forms part of the table top structure.

In another embodiment, the U-shaped or C-shaped frame may open upwards such that the web of the frame is against floor or ground and the table support legs connect to the table top structure. In this embodiment, the frames do not form the first and second table top ends.

In an alternative embodiment, a first table end frame is provided in connection with the table top structure. The first table end frame has a circumferential form defining the first opening of the game space and arranged to form the support legs and the first table top end. The game table further comprises a second table end frame provided in connection with table top structure. The second table end frame has a circumferential form defining the second opening of the channel-like game space and arranged to form the support legs and the second table top end. The circumferential form may be for example square or rectangular form or some other form. Accordingly, the circumferential frames form part of the table side wall structure and part of the table top structure. The circumferential frame is advantageous for defining the first and second opening the channel-like game space and for forming a rigid and sturdy structure for the game table.

The game table may also comprise a table bottom structure forming the bottom of the channel-like game space. In one embodiment, the bottom structure comprises a table bottom wall. The table bottom wall may be a mat, plate or some other type of planar element arranged under the table top structure for forming the bottom of the channel-like game space. The bottom wall may be provided soft or resilient for providing the bottom for the channel-like game space. The bottom wall may be for example at least 5 mm, or at least 10 mm, or even at least 20 mm thick mat or plate, or alternatively the thickness may be between 10 to 50 mm, or 20 to 40 mm, or between the 25 to 35 mm. The bottom wall preferably covers the whole bottom surface under the table top structure. Bottom walls having greater thickness may be used a structural component of the game table.

In one embodiment, the table side walls are connected to the table bottom structure or table bottom wall. This is especially advantageous when the table side wall is made of flexible or resilient material. Furthermore, in one embodiment the side table side walls may be provided as integral parts of the bottom structure or bottom wall.

The table side walls may be provided from flexible material and with a coiling mechanism. The coiling mechanism may be any know type of coiling mechanism enabling coiling the flexible table side wall on a coil to a coiled-up state in which the side wall structure is open, and releasing the flexible table side wall from the coil to coiled-out or expanded state in which the table side wall covers the table side wall structure or forms the table side wall. The coiling mechanism may comprise one or more springs for automatically coiling the flexible table side wall. The coiling mechanism with the flexible table side wall may be arranged to the table bottom structure along the table side wall structure in the direction between the first and second ends of the table top structure or the first and second openings of the channel-like game space, for example the side edge of the table bottom wall, such that the flexible side wall may be coiled-out from the coiling mechanism and lifted-up, and secured to the table top structure or the support legs. Alternatively, the coiling mechanism with the flexible table side wall may be arranged to the table top structure along the table side wall structure in the direction between the first and second ends of the table top structure or the first and second openings of the channel-like game space, for example the table top side supports, such that the flexible side wall may be coiled-out from the coiling mechanism and lowered down, and secured to the table bottom structure or the support legs. Yet alternatively, the coiling mechanism with the flexible table side wall may be arranged to the first support leg along the first support leg in the direction between the table bottom structure and the table top structure, such that the flexible side wall may be coiled-out from the coiling mechanism and drawn, and secured to second support leg of the table side wall structure. In the same manner the coiling mechanism may be provided alternative to the second support leg.

The present invention further relates to a game equipment for exercise by playing a ball game with legs. The game equipment comprises a game table and seats at the opposite ends of the game table for playing ball game in a game space defined by the game table with legs while sitting.

The game equipment comprises a game table. The game table comprises a table top structure with a see-through table top surface. The table top structure has a first table top end and a second table top end and a first table top side and a second table top side. The first and second table top sides extending between the first and second table top ends. The game table further comprises a first table side wall structure extending downwards from the table top structure and a second table side wall structure extending downwards from the table top structure. The first and second table side wall structures may also be arranged to form table standing supports for supporting the game table and the table top structure on a floor or ground. The first and second table side wall structures are arranged to form a channel-like game space together with the table top structure. The channel-like game space has a first opening and a second opening at opposite ends of the channel-like game space. The game table may be any kind of game table, as described above.

The game equipment of the present invention also comprises a first seat arranged in connection with the first opening of the channel-like game space and a second seat arranged in connection with the second opening of the channel-like game space. The first and second seat allow the player to sit outside the channel-like game space while playing such that the legs of the player may be placed inside the channel-like game space via the first and second openings of the channel-like game space.

The first and second seat may comprise a seat top structure arranged to form a seating surface. The seat top structure may have a first seat top end and a second seat top end and a first seat top side and a second seat top side. The first and second seat top sides extend between the first and second seat top ends. Furthermore, the first seat top end is arranged towards the channel-like game space. The first and second seat may also comprise a first seat side wall extending downwards from the seat top structure, a second seat side wall extending downwards from the seat top structure and a seat back wall extending downwards from the seat top structure. Therefore, the first and second seat side walls may be arranged to form a goal space together with the seat top structure and the seat back wall, the goal space having a goal opening towards the channel-like game space. The goal opening may be defined by the seat top structure and seat side walls at the first seat top end towards the channel-like game space. Therefore, the first and second seat may form goals into which the players try to kick the ball while playing.

In one embodiment, the first and second seat may comprise seat bottom structure provided under the seat top structure. The seat bottom structure may form the bottom of the goal space. In one embodiment, the seat bottom structure comprises a seat bottom wall. The seat bottom wall may be a mat, plate or some other type of planar element or surface element arranged under the seat top structure for forming the bottom of the goal space.

In one embodiment, the seat bottom structure comprises an upward rising surface. The upward rising surface may be provided such that it rises towards the seat back wall and/or towards to the seat top structure. Accordingly, the height of the rising surface increases in a direction from the goal opening or the first seat top end towards the seat back wall or the second seat top end. The upward rising surface returns the ball towards the channel-like game space when the ball is scored into the goal space.

In another embodiment, the first and second seat may comprise seat bottom structure provided under the seat top structure. In this embodiment, the seat bottom structure comprises seat bottom wall extending under the seat top structure and between the seat side walls. The seat bottom wall may comprise the upward rising surface and the upwards rising surface may be formed by the seat bottom wall.

It should be noted that the first seat or the second seat or a seat for the game table may be a separate and individual element of the game equipment. Therefore, the seat may be separated from the game table. Furthermore, in this application the seat may be handled as a separate element or in connection with the game table. Thus, it is evident that the seat may be also considered as separate inventive element or as a part of the game table or the game equipment.

In a preferred embodiment, the height of the first and second openings of the game space are greater than the height of the first and second seats such that a leg opening is provided between the seat top structure of the first and second seat and the table top structure at the opposite ends of the channel-like game space. Accordingly, the table top structure is at higher level than the seat top structure such that the leg opening is formed to the first and second openings of the channel-like game space between the table top structure and the seat top structure. Thus, when the player sits on the seat the legs of the player are placed through the leg opening into the channel-like game space. At the same time, the goal is provided under the seat or the seat top structure and the player may guard the goal or play goalkeeper with the legs. The height of the seat may be at least 30 cm, or at least 40 cm or equal to or greater than 45 cm. This means that the seat top structure or the seat top surface may be at the mentioned height from floor or ground or from a bottom structure or bottom wall of the game table. Alternatively, the height of the goal opening may be at least 30 cm, or at least 40 cm or equal to or greater than 45 cm from the floor, ground or bottom of the game table. The mentioned height enables players to play the game with legs through first and second openings of the channel-like game space while sitting on the seat.

In one embodiment, the first and second seats are connected or secured to the game table. This allows the seats to remain at their position relative to the game table during playing. In one embodiment, the first and second seats are mechanically connected or secured to the game table. Preferably, the first and second seat are releasably connected or secured to the game table such that they may be removed from the game table or moved relative to the game table when desired. Accordingly, the game equipment may comprise mechanical securing elements for securing the first and second seat to the game table. The securing elements may be provided such that the seat and the game table may be secured to each other. Both the game table and the seats may comprise securing elements.

The game table of the present invention forms confined channel-like game space and the openings at the opposite ends of the channel-like game space. The see-through table top surface of the table top structure allows a person to play with legs using the game table at one of the openings of the channel-like game table and visually see inside the channel-like game space. The channel-like game space prevents the ball from escaping the game table and allowing the ball game to be played indoors.

The game equipment comprising the game table and the first and second seats at the opposite ends and opposite openings of the channel-like game space allow the player to exercise legs and lower body by playing the game while sitting. This allows also people having limited leg mobility or restricted ability to hold themselves up with legs to play ball game with legs. This is good rehabilitation or exercising for people having injury at leg(s) or lower body.

BRIEF DESCRIPTION OF THE DRAWINGS

The invention is described in detail by means of specific embodiments with reference to the enclosed drawings, in which.

DETAILED DESCRIPTION OF THE INVENTION

Figure 1:
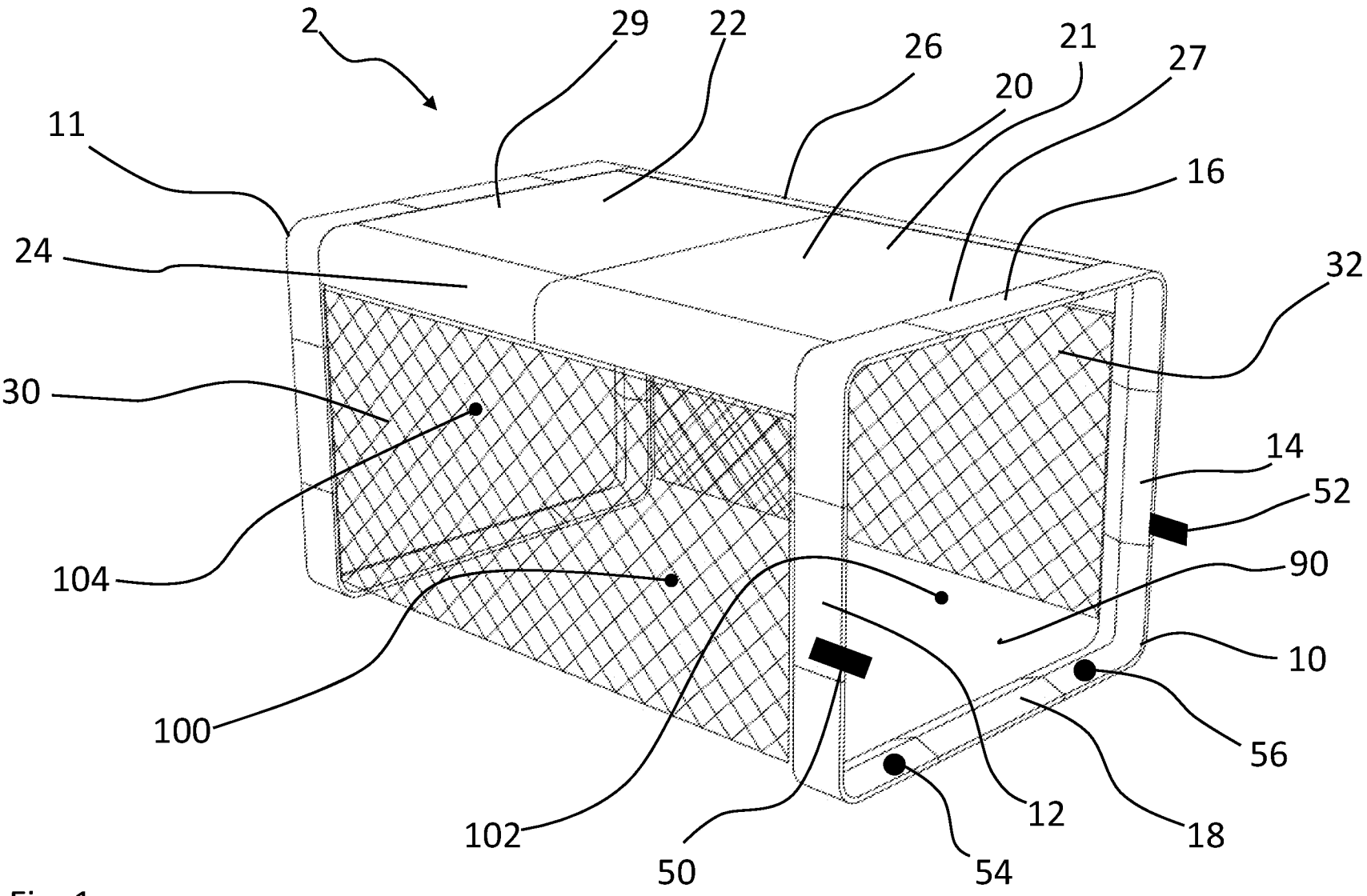
FIG. 1 shows schematically one embodiment of a game table according to the present invention.

FIG. 1 shows one embodiment of a game table 2 according to the present invention. The game table 2 comprises table top structure 20 and first table side wall structure 30 and a second table side wall structure 32. The table top structure 20 forms the table top and the first and second side wall structures 30, 32 form side walls for the game table 2 and also the standing supports for the game table 2.

The table top structure 20 comprises a first table top end 27 and a second table top end 29, and a first table top side 24 and a second table top side 26. The first and second table top sides 24, 26 extend between the first and second table top ends 27, 29. The first and second table side wall structures 30, 32 extend downwards from the first and second table top sides 24, 26, respectively. The table top structure 20 comprises a see-through table top surface.

The table top surface may be provided with one or more see-through openings between the first and second table top ends 27, 29 and between the first and second table top sides 24, 26. Alternatively, the table top surface may be provided with one or more table top walls 21, 22. The table top walls 21, 22 may be supported to the table top sides 24, 26 and/or top table top ends 27, 29. However, it should be noted that the whole table top structure 20 may be formed with one or more table top walls such that the one or more table top walls form the first and second table top sides and first and second table top ends.

The first and second table side wall structures 30, 32 provide table sides walls and standing supports for the game table 2 for supporting the game table 2 on a floor or ground. The first and second table side wall structures 30, 32 are arranged to form a channel-like game space 100 together with the table top structure 20. The game space 100 is the inner space of the game table 2. The channel-like game space 100 is defined on the bottom by the floor of the ground or a special bottom structure of the game table 2. The channel-like game space 100 has a first opening 102 and a second opening 104 at opposite ends of the channel-like game space 100, or at the opposite ends 27, 29 to the table top structure 20. The first and second openings 102, 104 extending in substantially vertical direction. Furthermore, the table top surface or table top wall(s) 21, 22 extend in substantially horizontal direction and the table side walls 30, 32 extend substantially in vertical direction. The first and second table side wall structures 30, 32 of the first and second table side walls are arranged spaced apart and opposite to each other, preferably substantially parallel.

The table top wall(s) may be provided by a solid table top wall 21, 22 made of transparent material and arranged to form top wall surface of the game space 100 and the see-through table top surface into the game space 100 from above the table top structure 20. The transparent table top walls 21, 22 may be made of any suitable material enabling transparency such that the player may see into the game space 100 through the solid table top wall. Alternatively, the table top wall(s) may be provided by a net-like table top wall having plurality of net apertures and arranged to form top wall surface of the game space 100 and the see-through table top surface into the game space 100 from above the table top structure 20. In this embodiment the net apertures provide the see-through feature into the game space 100. The see-through table top surface or the see-through table top wall may be arranged to form a see-through structure into the channel-like game space 100. Thus, the see-through table top surface provides visibility into the channel-like game space 100. Further, the see-through table top surface enables the player to see into the channel-like game space 100 from outside the channel-like game space 100 and above the game table or the channel-like game space 100.

As shown in FIG. 1, the game table 2 comprises a first table end frame 10 provided in connection with the table top structure 20 or connected to the table top structure 20 at the first table top end 27. The game table 2 further comprises a second table end frame 11 provided in connection with the table top structure 20 or connected to the table top structure 20. The first table end frame 10 is provided in connection with the first table top end 27 or connected to the first table top end 27. Similarly, the second table end frame 11 is provided in connection with the second table top end 29 or connected to the second table top end 29.

In the embodiment of FIG. 1, the first and second table end frames 10, 11 have a circumferential or O-shaped form defining the first opening 102 of the game space 100 and the second opening 104 of the game space 100, respectively. Circumferential form means that the first and second end frames form a loop, as shown in FIG. 1.

The first and second circumferential table end frames 10, 11 have a substantially square or rectangular shape. Accordingly, the circumferential table end frame 10, 11 comprises upper frame part 16, a lower frame part 18 and two opposite side frame parts 12, 14 extending between the upper and lower frame parts 16, 18. The table end frames 10, 11 may be made of wood, plastic or metal, such as aluminium, or any other suitable rigid material. The table end frames 10, 11 may be made from one or more bar or beam elements.

The table top structure 20 further comprises table top side supports 24, 26 forming the table top sides 24, 26. The table top side supports 24, 26 extend between the table top ends 27, 29 or between the table end frames 10, 11. As shown in FIG. 1 the first and second table top side supports 24, 26 are connected or attached to the table end frames 10, 11. Therefore, the table end frames 10, 11 and the first and second table top side supports 24, 26 together form the game table frame, which is the support frame of the game table 2.

The first and second end frames 10, 11 may form part of the table top structure 20 and the first and second table side wall structure 30, 32, as shown in FIG. 1.

The upper frame parts 16 may form part of the table top structure 20, and especially form table top end supports such that the upper frame parts 16 also form the first and second table top ends 27, 29, respectively.

The table top wall(s) 21, 22 may be supported or attached to the table top side supports 24, 26 or to the table top end supports 16, meaning the upper frame parts 16. Alternatively, the table top wall(s) 21, 22 may be supported or attached to the table top side supports 24, 26 and to the table top end supports 16, meaning the upper frame parts 16. The table top side supports 24, 26 extend substantially in horizontal direction. The table top side supports 24, 26 may be made from one or more bar or beam elements.

The side frame parts 12, 14 may form part of the table side wall structure 30, 32 and also support legs of the game table for providing standing support for the game table 2. The side frame parts 12, 14 extend downwards from the table top structure 20 and the from the upper frame part 16.

The first and second table side wall structure 30, 32 further comprises first and second table side wall 30, 32 forming the side walls of the channel-like game space 100. The first and second table side wall 30, 32 may be a solid table side walls made of transparent or non-transparent material and arranged to form table side wall surface of the game space 100. Alternatively, the first and second table side wall 30, 32 may be net-like table side walls having plurality of net apertures and arranged to form table side wall surface of the game space 100, as shown in FIG. 1.

The first and second table side walls 30, 32 may be made of rigid material, flexible material, or elastic material. The first and second table side walls 30, 32 may be supported or attached to the side frame parts 12, 14 or to the table top side supports 24, 26. Alternatively, the first and second table side walls 30, 32 may be supported or attached to the side frame parts 12, 14 and to the table top side supports 24, 26.

The game table 2 may also comprise a table bottom structure 90. The table bottom structure 90 may comprise a bottom wall which may be for example a mat or plate forming the game surface inside the game table 2.

As shown in FIG. 1, the game table 2 comprises the circumferential first and second table end frames 10, 11. However, it should be noted that the first and second table end frame 10, 11 may also be provided as U-shaped or C-shaped frames such that the upper frame part 16 or the lower frame part 18 may be omitted. In a yet alternative embodiment, the game table 2 or the first and second table side wall structure 30, 32 comprise separate table support legs (not shown) extending from the table top structure 20 downwards. In this embodiment, a table support leg may be provided in connection with the first and second table top end 27, 29 such that the support legs define the first and second opening 102, 104 with the first and second table top ends 27, 29, respectively.

Furthermore, the table top structure 20 may also be formed only by one or more table top walls 21, 22.

Additionally, the first and second table side wall structures 30, 32 may also be formed only by one or more table side walls. These alternative structural variations may be combined in any suitable manner in order to form the game table 2 having the channel-like game space 100.

Figure 2:
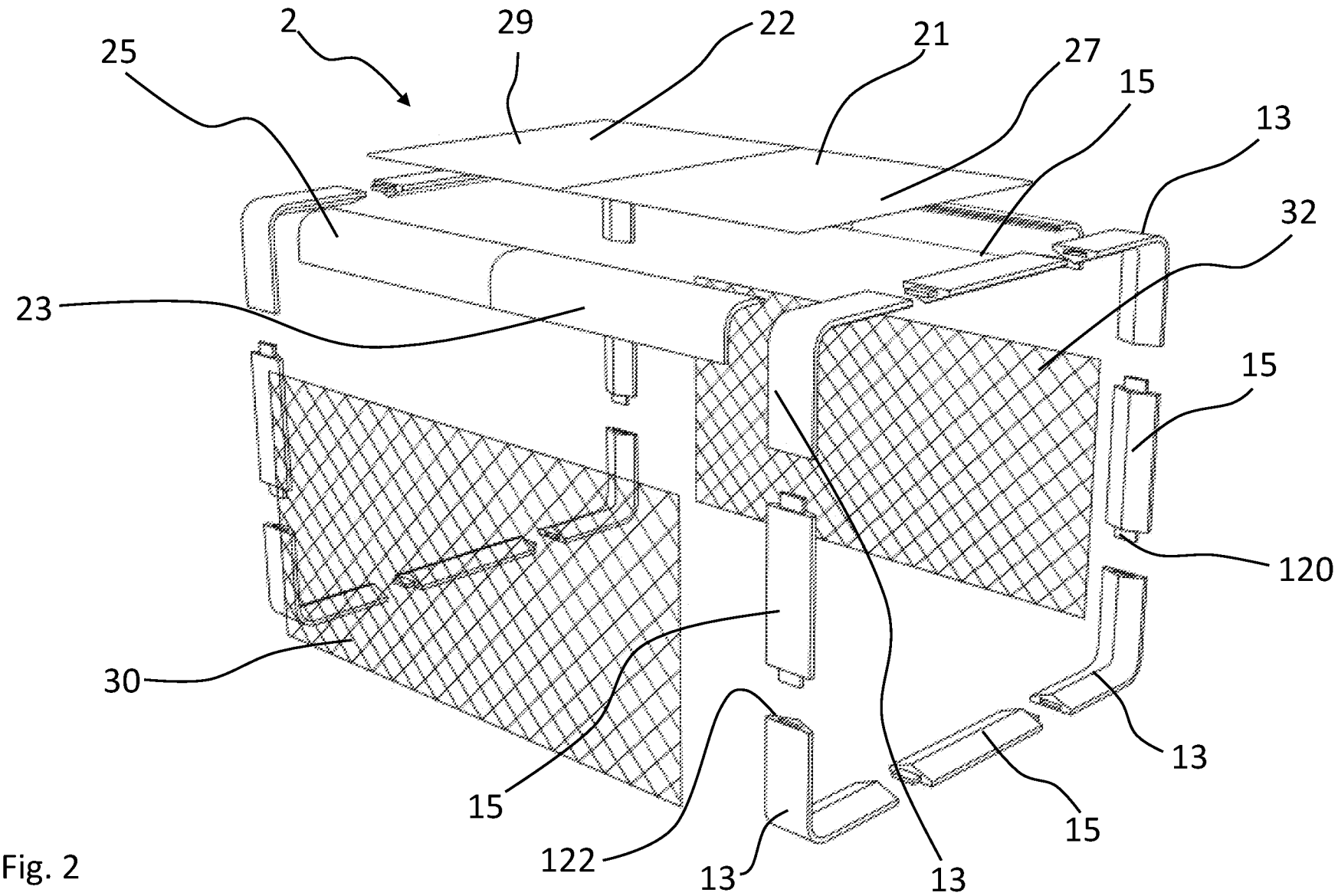
FIG. 2 shows an exploded view of the game table of FIG. 1.

FIG. 2 shows an exploded view of the game table 2 of FIG. 1. The first and second end frames 10, 11 are formed from separate frame elements 13, 15 connected or connectable together. The separate frame elements 13, 15 are connectable to each other with a mechanical frame connection 120, 122. The mechanical frame connection 120, 122 may be any kind of known mechanical connection or joint. In the embodiment of FIG. 2, the mechanical frame connection 120, 122 is a mortise-and-tenon joint. Therefore, the frame elements 13, 15 comprise tenons 120 and mortises 122 for receiving tenons 120 in order to form the connections.

In the embodiment of FIG. 2, the first and second end frames 10, 11 comprise corner frame elements 13 and straight frame elements 15. The corner frame elements 13 and straight frame elements 15 together form the circumferential frame 10, 11 when connected to each other.

The straight frame elements 15 comprises the tenons 120 at opposite ends and the corner frame elements 13 comprise the mortises 122 at opposite ends for receiving the tenons 120 of the straight frame elements 15. There is provided one straight frame element 15 between two corner frame elements 13, as shown in FIG. 2. The corner frame elements 13 have a substantially right angle, meaning substantially 90 degrees' angle. Furthermore, the straight frame elements 15 may be similar or identical relative to each other, and also the corner frame elements 13 may be similar or identical relative to each other. This makes manufacturing and assembling the game table efficient and easy. Furthermore, this enables forming the first and second openings 102, 104 of the game space 100 in square shape.

Figure 4:
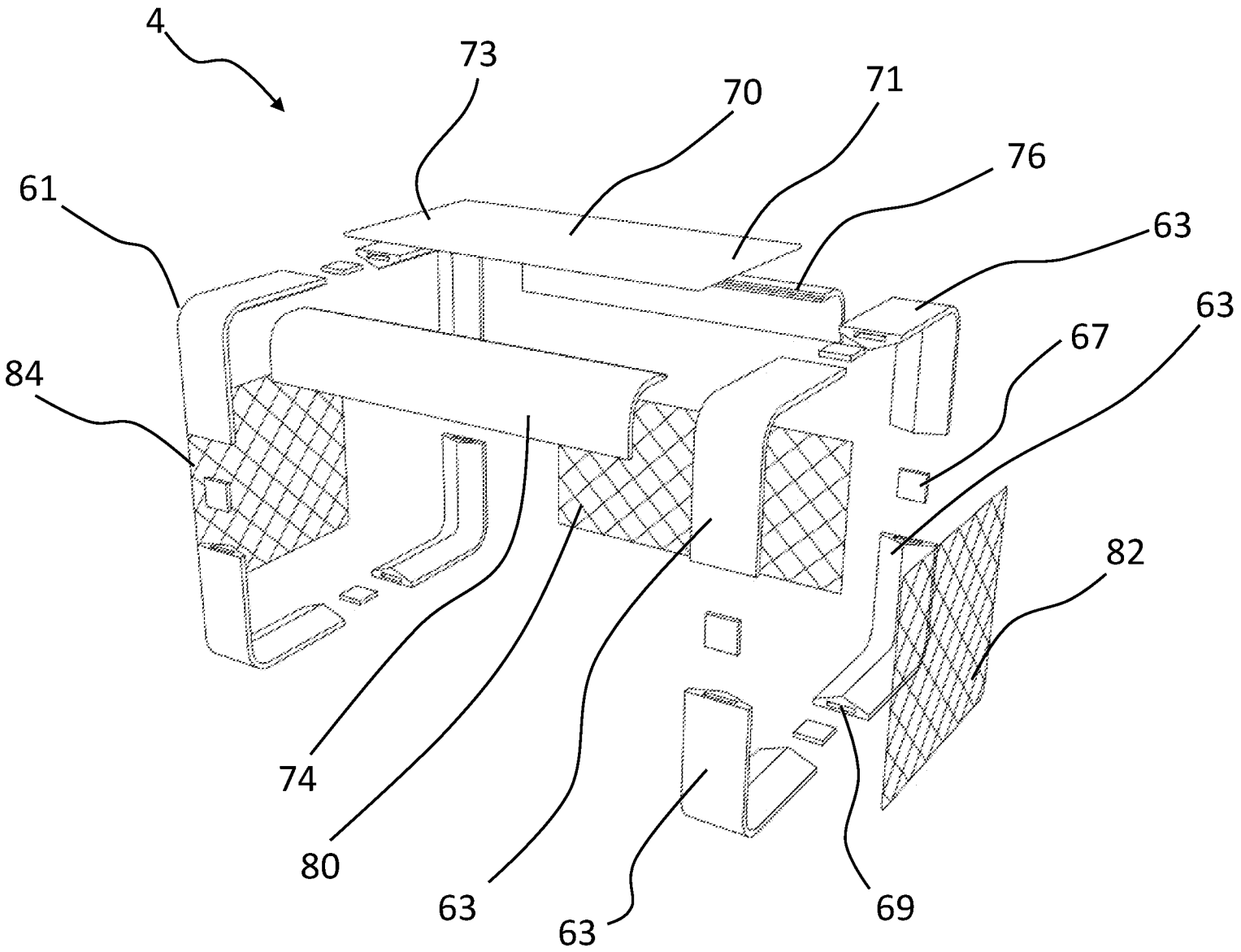
FIG. 4 shows an exploded view of the seat of FIG. 3.

It should be noted, that the number of straight frame elements 15 between two corner frame elements may vary and also the shape of the corner frame elements 13 may vary such that the first and second openings 102, 104 of the game space 100 may have shape different than square. Furthermore, the tenon-and-mortise joint 120, 122 may be provided in different manner or some other kind of mechanical joint may be used. The tenon-and-mortise joint 120, 122 may also be formed such that each corner frame element 13 and straight frame element 15 comprises a mortise or hole 122 and the tenons 120 are separate parts, in similar manner as shown in FIG. 4.

The first and second table top side supports 24, 26 may be connected to the first and second end frames 10, 11 with mechanical connections, such as the tenon-and-mortise joint similar to the tenon-and-mortise joint 120, 122 of the first and second end frames 10, 11. The first and second table top side supports 24, 26 may also be formed from one or more table top side support parts 23, 25 connected to each other, also preferably with a mechanical joint. In preferred embodiment, the one or more table top side support parts 23, 25 are similar or identical to the straight frame elements 15. This further makes manufacturing and assembling the game table efficient and easy, as the number of different elements may be minimized. In this case, there may more side support parts 23, 25 on each table top side than straight frame elements 15 at the top structure of the end frames 10, 11 for proving the longitudinal channel-like game space 100 between the first and second ends of the game space 100.

Figure 3:
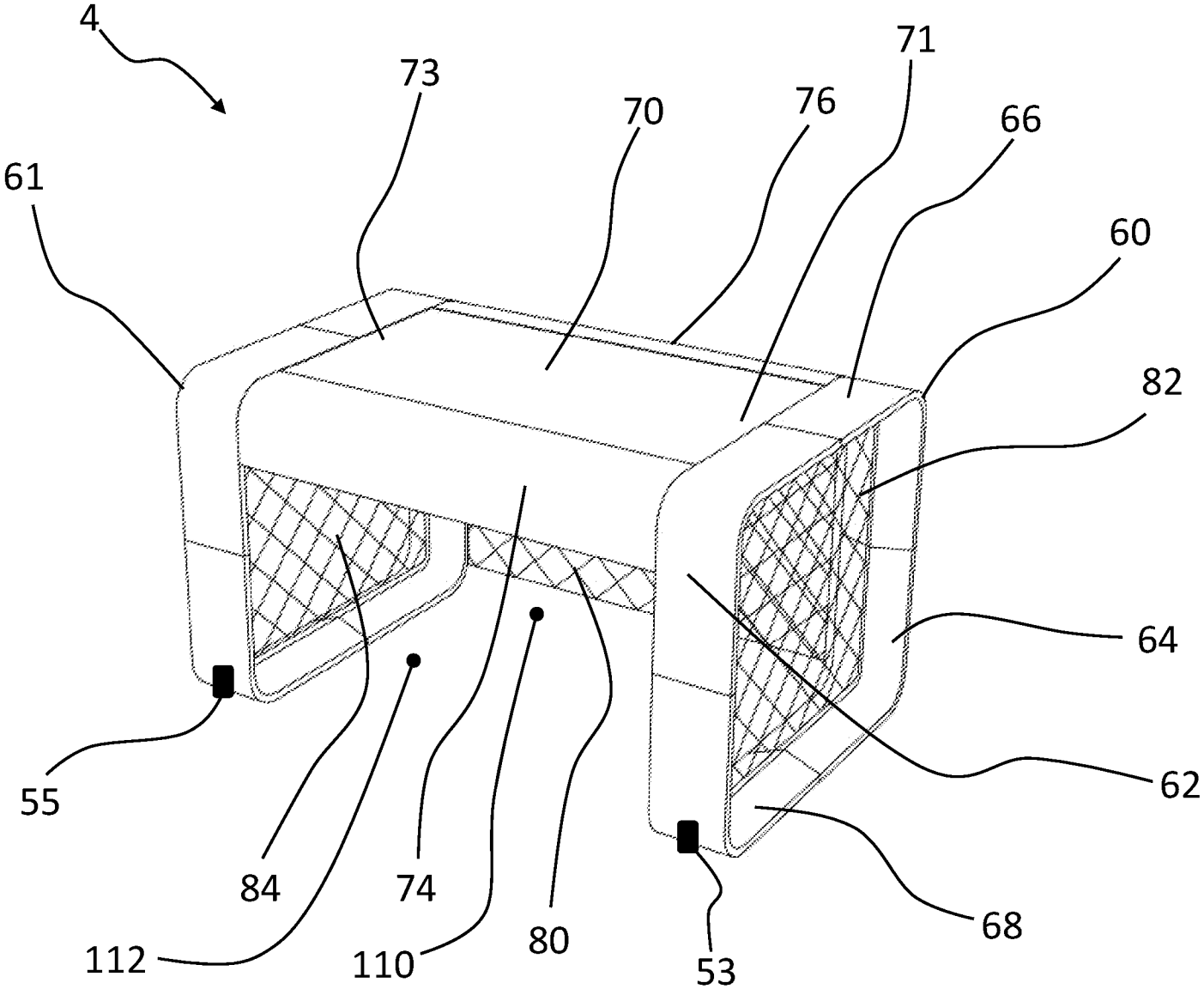
FIG. 3 shows schematically one embodiment of a seat for the game table according to the present invention.

FIG. 3 shows a seat 4 to be used with the game table 2 for forming a game equipment. The seat 4 comprises a seat top structure 70 arranged to form a seating surface. The set top structure 70 has a first seat top end 74 and a second seat top end 76 and a first seat top side 71 and a second seat top side 73. The first and second seat top sides 71, 73 extending between the first and second seat top ends 74, 76. The seat 4 further comprises a first seat side wall 82 extending downwards from the seat top structure 70, a second seat side wall 84 extending downwards from the seat top structure 70 and a seat back wall 80 extending downwards from the seat top structure 70. The first and second seat side walls 82, 84 are arranged to form a goal space 110 together with the seat top structure 20 and the seat back wall 80.

The first and second seat side walls 82, 84 are arranged to extend downwards from the seat top structure 70 at the first and second seat top sides 71, 73 or in the vicinity thereof, respectively. The seat back wall 80 is arranged to extend downwards from the seat top structure 70 at the second seat top end 76 or in the vicinity thereof. The first and second seat side walls 82, 84 and the first seat top end 74 of the seat top structure 70 define a goal opening 112 into the goal space 110 at the seat top end 76, as shown in FIG. 3. The goal space 110 is the inner space of the seat 4. The goal space 110 is defined on the bottom by the floor of the ground or a special bottom structure of the seat 4. The goal opening 112 extends in substantially vertical direction. Furthermore, the seat top surface or seat top wall 70 extend in substantially horizontal direction and the seat side walls 82, 84 extend substantially in vertical direction. The first and second seat side wall structures 82, 84 may provide seat sides walls and standing supports for the seat 4 on a floor or ground.

The seat top structure 70 comprises top wall forming the seat surface on which the player may sit. The seat top wall may be supported to the seat top sides 71, 73 and/or the seat top ends 74, 76. However, it should be noted that the whole seat top structure 70 may be formed with one or more seat top walls such that the one or more seat top walls form the first and second seat top sides and the first and second table top ends.

The first and second seat side walls 82, 34 and the seat back wall 80 may comprise solid seat side walls made of transparent or non-transparent material and arranged to form seat side wall surfaces of the goal space 110. Alternatively, the first and second seat side walls 82, 84 and the seat back wall 80 may be net-like seat side walls having plurality of net apertures and arranged to form seat side wall surfaces of the goal space 110, as shown in FIG. 3. The first and second seat side walls 82, 84 and the seat back wall 80 may be made of rigid material, flexible material, or elastic material.

As shown in FIG. 3, the seat 4 comprises a first seat side frame 60 provided in connection with the seat top structure 70 or connected to the seat top structure 70 at the first seat top side 71. The seat 4 further comprises a second seat side frame 61 provided in connection with the seat top structure 70 or connected to the seat top structure 70 at the second seat top side 73. The first seat side frame 60 is provided in connection with the first seat top side 71 or connected to the first seat top side 71. Similarly, the second seat side frame 61 is provided in connection with the second seat top side 73 or connected to the second seat top end 73.

In the embodiment of FIG. 3, the first and second table end frames 60, 61 have a circumferential form such that the seat side walls 82, 84 are respectively provided inside the first and second seat side frames 60, 61 and connected thereto. Circumferential form means that the first and second seat side frames 60, 61 form a loop, as shown in FIG. 4. The seat back wall 80 is also connected or supported to the first and second seat side frames 60, 61 and between them. The seat back wall 80 may also be connected and supported to the seat top structure 70.

The first and second circumferential seat side frames 60, 61 have a substantially square or rectangular shape. Accordingly, the circumferential seat side frame 60, 61 comprises upper frame part 66, a lower frame part 68 and two opposite side frame parts 62, 64 extending between the upper and lower frame parts 66, 68. The seat side frames 60, 61 may be made of wood, plastic or metal, such as aluminium, or any other suitable rigid material. The seat side frames 60, 61 may be made from one or more bar or beam elements.

The seat top structure 70 further comprises seat top front and back supports 74, 76, or seat top end supports, forming the seat top ends 74, 76. The seat top end supports 74, 76 extend between the seat top sides 71, 73 or between the seat side frames 60, 61. As shown in FIG. 3 the first and second seat top end supports 74, 76 are connected or attached to the seat side frames 60, 61. Therefore, the seat side frames 60, 61 and the first and second seat top end supports 74, 76 together form the seat frame, which is the support frame of the seat 4.

The first and second seat side frames 60, 61 may form part of the seat top structure 70 and the first and second seat side walls 82, 84, as shown in FIG. 3.

The upper seat frame parts 76 may form part of the seat top structure 70, and especially form seat top side supports such that the seat upper frame parts 76 also form the first and second seat top sides 71, 73, respectively.

The seat top wall 70 may be supported or attached to the seat top end supports 74, 76 or to the seat top side supports 76, meaning the upper seat frame parts 76. Alternatively, the seat top wall 70 may be supported or attached to the seat top end supports 74, 76 and to the seat top side supports 76, meaning the upper seat frame parts 76. The seat top end supports 74, 76 extend substantially in horizontal direction. The seat end side supports 74, 76 may be made from one or more bar or beam elements.

The side seat frame parts 62, 64 may form part of the seat side wall 82, 84 and also support legs of the seat 4 for providing standing support for the seat 4. The side seat frame parts 62, 64 extend downwards from the seat top structure 70 and the from the upper seat frame part 76.

Figure 5:
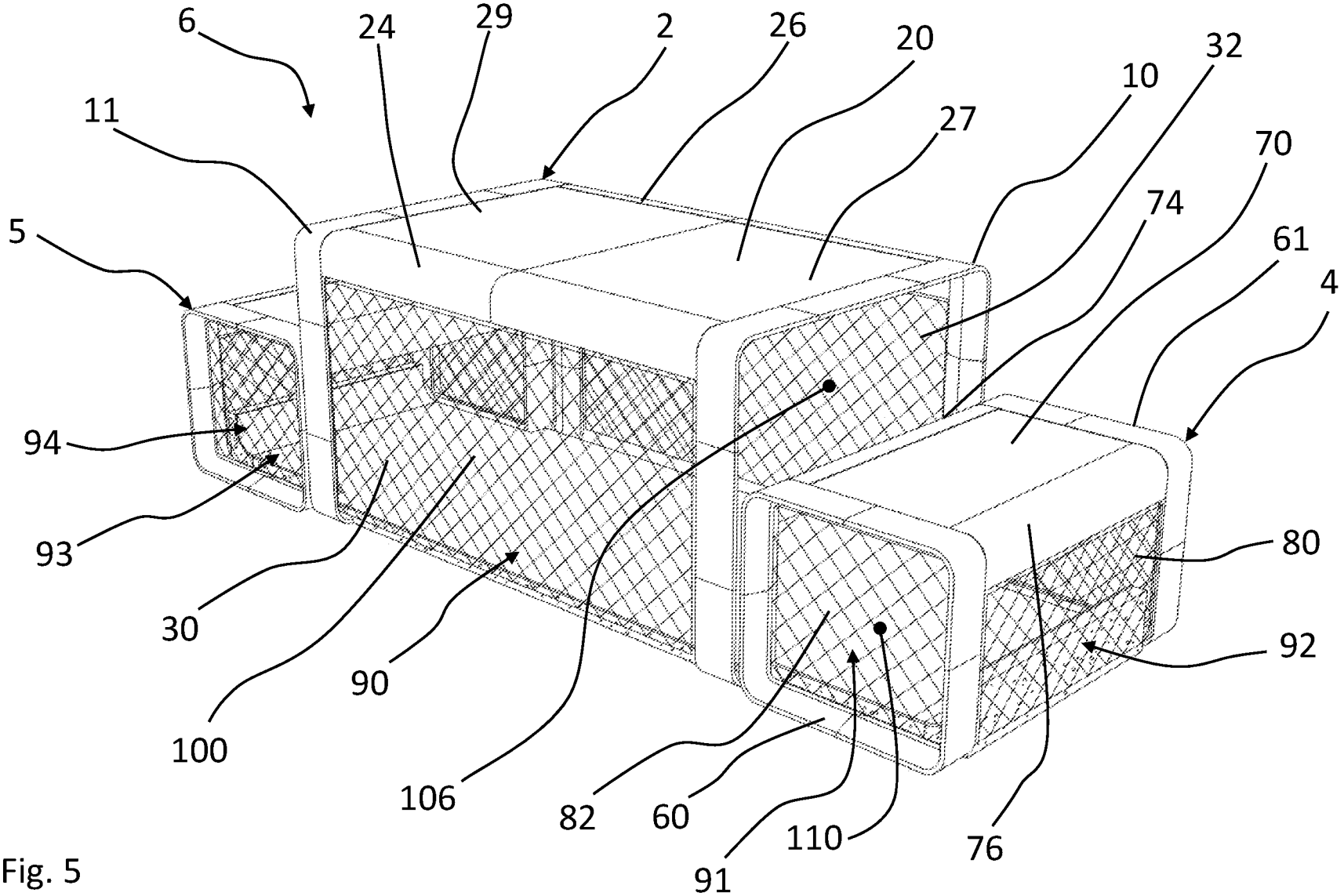
FIG. 5 shows a schematic view of one embodiment of a game equipment according to the present invention.

The seat 4 may also comprise a seat bottom structure 91, 92, 93, 94 provided under the seat top structure 70, as shown in FIG. 5. The seat bottom structure 91, 92, 93, 94 may comprise seat bottom wall 91, 93 extending under the seat top structure 70 and between the seat side walls 82, 84. The seat bottom structure or the seat bottom wall 91, 93 may also comprise an upward rising surface 92, 94. The upward rising surface 92, 94 may be arranged to rise upwards towards the seat back wall 80 from the goal opening 112 inside the goal space 110. The seat bottom wall 91, 93 may be for example a mat or plate.

As shown in FIG. 3, the seat 4 comprises the circumferential first and second seat side frames 60, 61. However, it should be noted that the first and second seat side frames 60, 61 may also be provided as U-shaped or C-shaped frames such that the upper seat frame part 66 or the lower seat frame part 68 may be omitted. In a yet alternative embodiment, the seat 4 or the first and second seat side walls 82, 84 comprise separate support legs (not shown) extending from the seat top structure 70 downwards. In this embodiment, a support leg may be provided in connection with the first and second seat top sides 71, 73 such that the support legs define the goal opening 112 with the first seat top end 74.

Furthermore, the seat top structure 70 may also be formed only by one or more seat top wall.

Additionally, the first and second seat side walls 82, 84 may also be formed only by one or more seat side walls 82, 84, without the frames 60, 61 or supports. These alternative structural variations may be combined in any suitable manner in order to form the seat 4.

The first and second seat side walls 82, 84 and the seat back wall 80 may be supported or attached to the side seat frame parts 62, 44 or to the seat top end supports 74, 76. Alternatively, the first and second seat side walls 82, 84 may be supported or attached to the side seat frame parts 62, 64 and to the seat top end supports 74, 76.

FIG. 4 shows an exploded view of the seat of FIG. 3. The first and second seat side frames 60, 61 are formed from separate seat frame elements 63 connected or connectable together. The separate seat frame elements 63 are connectable to each other with a mechanical frame connection 67, 69. The mechanical frame connection 67, 69 may be any kind of known mechanical connection or joint. In the embodiment of FIG. 4, the mechanical frame connection 67, 69 is a mortise-and-tenon joint. Therefore, the seat frame elements 63 comprise mortises 69 for receiving separate tenons 67 in order to form the connections.

In the embodiment of FIG. 4, the first and second seat side frames 60, 61 comprise corner seat frame elements 63. The corner frame elements 63 form the circumferential frame 60, 61 when connected to each other.

The corner seat frame elements 63 have a substantially right angle, meaning substantially 90 degrees' angle. Furthermore, the corner frame elements 63 are similar or identical relative to each other, and preferably also to corner frame elements 13 of the game table 2. This makes manufacturing and assembling the game table efficient and easy.

It should be noted, that the first and second seat side frames 60, 61 may also comprise straight seat frame elements, in the same manner as the game table 2, such that shape of the seat side frames 60, 61 may vary.

The first and second seat top end supports 74, 76 may be connected to the first and second seat side frames 60, 61 with mechanical connections, such as the tenon-and-mortise joint similar to the tenon-and-mortise joint 67, 69 of the first and second seat side frames 60, 61, or 120, 122 of the first and second end frames 10, 11. The first and second seat top end supports 74, 76 may also be formed from one or more seat top end support parts 74, 76 connected to each other, also preferably with a mechanical joint. In preferred embodiment, the one or more seat top end support parts 74, 76 are similar or identical to the straight frame elements 15 of the game table 2 or with the first and second table top side supports 24, 26. This further makes manufacturing and assembling the game table efficient and easy, as the number of different elements may be minimized.

FIG. 5 shows the game equipment 6 in assembled state. The game equipment 6 comprises the game table 2 and a first seat 4 arranged in connection with the first opening 102 of the channel-like game space 100 and second seat 5 arranged in connection with the second opening of the channel-like game space.

The first and second seat allow the player to sit outside the channel-like game space while playing such that the legs of the player may be placed inside the channel-like game space via the first and second openings of the channel-like game space. The first and send seat 4, 5 are arranged to first and second opening 102, 104 such that the first seat top end 74 and the goal opening 112 are towards the game table 2, the first and second openings 102, 104 and the game space 100.

The first and second seat 4, 5 may be preferably connected or secured to the game table 2. In one embodiment, the first and second seats 4, 5 are mechanically connected or secured to the game table 2. Preferably, the first and second seats 4, 5 are releasably connected or secured to the game table 2 such that they may be removed from the game table 2 or moved relative to the game table 2 when desired. Accordingly, the game equipment 6 may comprise mechanical securing elements 50, 52, 53, 54, 55, 56 for securing the first and second seat 4, 5 to the game table 2. The securing elements may be provided such that the seat 4, 5 and the game table 2 may be secured to each other. The game table 2 may comprise first securing elements 50, 52, 54, 56 and the seats 4, 5 may comprise second securing elements 53, 55 for securing the seat 4, 5 and the game table 2 together. The seats 4, 5 are arranged close to the game table 2 such that the table end frames 10, 11, or the table support legs of the game table 2 are close or in contact with the seats 4, 5 or the seat side frames 60, 61 or the seat support legs.

The height of the first and second openings 102, 104 of the game space 100 are less than the height of the first and second seats 4, 5 such that a leg opening 106 is provided between the seat top structure 20 of the first and second seat 4, 5 and the table top structure 20 at the opposite ends of the channel-like game space 100. Accordingly, the table top structure 20 is at higher level than the seat top structure 70 such that the leg opening 106 is formed to the first and second openings 102, 104 of the channel-like game space 100 between the table top structure 20 and the seat top structure 70. This allows the player to sit on the seat 4, 5 and place legs through the leg opening 106 into the channel-like game space 100. At the same time, the goal opening 112 open to the game space 100 via the first and second openings 102, 104 of the game space 100.

The bottom structure 90 of the game table 2 and the bottom structures 91, 93 of the seats 4, 5 may form an integral and uniform bottom structure extending under the table top structure 20 and the seat top structures 70. Accordingly, it also possible to secure the seats 4, 5 to the bottom structure 90, 91, 93 with mechanical connection. However, the bottom structure 90 of the game table 2 and the bottom structures 91, 93 of the seats 4, 5 may also be separated structures.

The invention has been described above with reference to the examples shown in the figures. However, the invention is in no way restricted to the above examples but may vary within the scope of the claims.

The invention claimed is:

1. A game equipment for exercise by playing a ball game with legs, the game equipment comprises: a game table comprising: a table top structure with a see-through table top surface, the table top structure having a first table top end and a second table top end and a first table top side and a second table top side, the first and second table top sides extending between the first and second table top ends, and a first table side wall structure extending downwards from the table top structure and a second table side wall structure extending downwards from the table top structure, the first and second side wall structures provide a see-through structure into the channel-like game space and prevent a ball from escaping the channel-like game space; the first and second table side wall structures being arranged to form a channel-like game space together with the table top structure, the channel-like game space having a first opening and a second opening at opposite ends of the channel-like game space; and wherein a length of the channel-like game space between the first and second openings is greater than a width of the channel-like game space between the first and second table side wall structures; the see-through table top surface is arranged to provide a see-through structure into the channel-like game space and prevent the ball from escaping the channel-like game space; the game equipment comprises a first seat arranged in connection with the first opening of the channel-like game space and a second seat arranged in connection with the second opening of the channel-like game space; and the first and second seat comprises: a seat top structure arranged to form a seating surface, the seat top structure having a first seat top end and a second seat top end and a first seat top side and a second seat top side, the first and second seat top sides extending between the first and second seat top ends, the first seat top end being arranged towards the channel-like game space, and a first seat side wall extending downwards from the seat top structure, a second seat side wall extending downwards from the seat top structure and a seat back wall extending downwards from the seat top structure, the first and second seat side walls being arranged to form a goal space together with the seat top structure and the seat back wall, the goal space having a goal opening towards the channel-like game space, the first and second seats are provided such that players sit on the first and second seats while playing the ball game, the first and second seat side walls and the first seat top end are arranged to define the goal opening, the first and second table side wall structure of the game table comprise table support legs extending from the table top structure downwards, the first and second table side wall structure comprising one table support leg provided in connection with the first and second table top end such that the table support legs define the first and second opening with the first and second table top ends, respectively, the height of the first and second openings of the game space are greater than the height of the first and second seats such that a leg opening is provided between the seat top structure of the first and second seats and the table top structure at the opposite ends of the channel-like game space, the leg openings at the opposite ends of the channel-like game space are provided such that legs of the players are placed through the leg openings into the channel-like game space at the opposite ends of the channel-like game space, respectively, while the players sit on the first and second seats.

2. The game equipment according to claim 1, wherein:

the first and second seat comprise seat bottom structure provided under the seat top structure, the seat bottom structure comprising an upward rising surface; or the first and second seat comprise seat bottom structure provided under the seat top structure, the seat bottom structure comprising a seat bottom wall extending under the seat top structure and between the seat side walls, and the seat bottom wall comprises an upward rising surface.

3. The game equipment according to claim 1, wherein the first and second seats are connected or secured to the game table; or the first and second seats are mechanically connected or secured to the game table; or the first and second seats are releasably connected or secured to the game table; or that the game equipment comprises mechanical securing elements for securing the first and second seat to the game table.

* * * * *